US006217359B1

(12) United States Patent
Chang

(10) Patent No.: US 6,217,359 B1
(45) Date of Patent: Apr. 17, 2001

(54) MOBILE RACK FOR REMOVABLE HARD DISK DRIVER

(76) Inventor: Dean Chang, 4F, No. 4, Lane 235, Pao Chiao Rd., Hsintien, Taipei Hsien (TW)

( * ) Notice: Subject to any disclaimer, the term of this patent is extended or adjusted under 35 U.S.C. 154(b) by 0 days.

(21) Appl. No.: 09/495,379

(22) Filed: Feb. 1, 2000

(51) Int. Cl.[7] ..... H01R 13/62
(52) U.S. Cl. ..... 439/297; 439/928.1
(58) Field of Search ..... 439/297, 374, 439/928.1

(56) References Cited

U.S. PATENT DOCUMENTS 5,882,220 * 3/1999 Horii et al. ..... 439/297
6,062,893 * 6/1998 Miskin et al. ..... 439/374

* cited by examiner

*Primary Examiner*—Tulsidas Patel
*Assistant Examiner*—Javaid Nasri

(74) *Attorney, Agent, or Firm*—Rosenberg, Klein & Lee

(57) ABSTRACT

A mobile rack for a removable hard disk driver, comprises an inner frame receiving the hard disk driver and an outer frame wherein the inner frame is slidably fit within the outer frame. The inner frame has at least one first connector on rear side thereof and comprising an insulating case and a plurality of conductive terminals within the insulating case. The insulating case of the inner frame has a first retainer on the rear end thereof to lock the first connector on rear side of the inner frame. The conductive terminals of the first connector are electrically connected to one end of a first flat cable and the other end of the flat cable is electrically connected to the hard disk driver. The outer frame has at least one second connector on rear side thereof and comprising an insulating case and a plurality of conductive terminals within the insulating case. The insulating case of the outer frame has a second retainer on the rear end thereof to lock the second connector on rear side of the outer frame. The conductive terminals of the second connector are electrically connected to one end of a second flat cable and the other end of the second flat cable electrically connected to the first connector. The production cost is reduced. Moreover, the signal transmission speed is enhanced.

3 Claims, 4 Drawing Sheets

MOBILE RACK FOR REMOVABLE HARD DISK DRIVER

FIELD OF THE INVENTION

The present invention relates to a mobile rack, especially to a mobile rack for removable hard disk driver, by which the production cost is reduced and the signal transmission speed is enhanced.

BACKGROUND OF THE INVENTION

FIGS. 1 and 2 shows the conventional removable hard disk driver 10*a* and the mobile rack thereof. The mobile rack comprises an inner frame 11*a* slidably fit within an outer frame 12*a*. The inner frame 11*a* has a first circuit board 13*a* on rear end thereof and having a first connector 14*a*. The first circuit board 13*a* is electrically connected to the removable hard disk driver 10*a*. The outer frame 12*a* has a second circuit board 15*a* on rear end thereof and having a second connector 16*a*. The second connector 16*a* is electrically connected to the first connector 14*a* to transmit electrical signal for the hard disk driver 10*a*.

However, in above conventional mobile rack for the removable hard disk driver 10*a,* two circuit boards 13*a* and 15*a* are required on the inner frame 11*a* and the outer frame 12*a,* respectively. The cost is high and the signal transmission speed is slow.

It is an object of the present invention to provide a mobile rack for removable hard disk driver, by which the production cost is reduced and the signal transmission speed is enhanced.

To achieve the above object, in the inventive mobile rack for removable hard disk driver, the circuit boards on the inner and outer frames are eliminated, thus reducing cost and enhancing spees.

The various objects and advantages of the present invention will be more readily understood from the following detailed description when read in conjunction with the appended drawing, in which:

DETAILED DESCRIPTION OF THE PREFERRED EMBODIMENT

Figure 1:
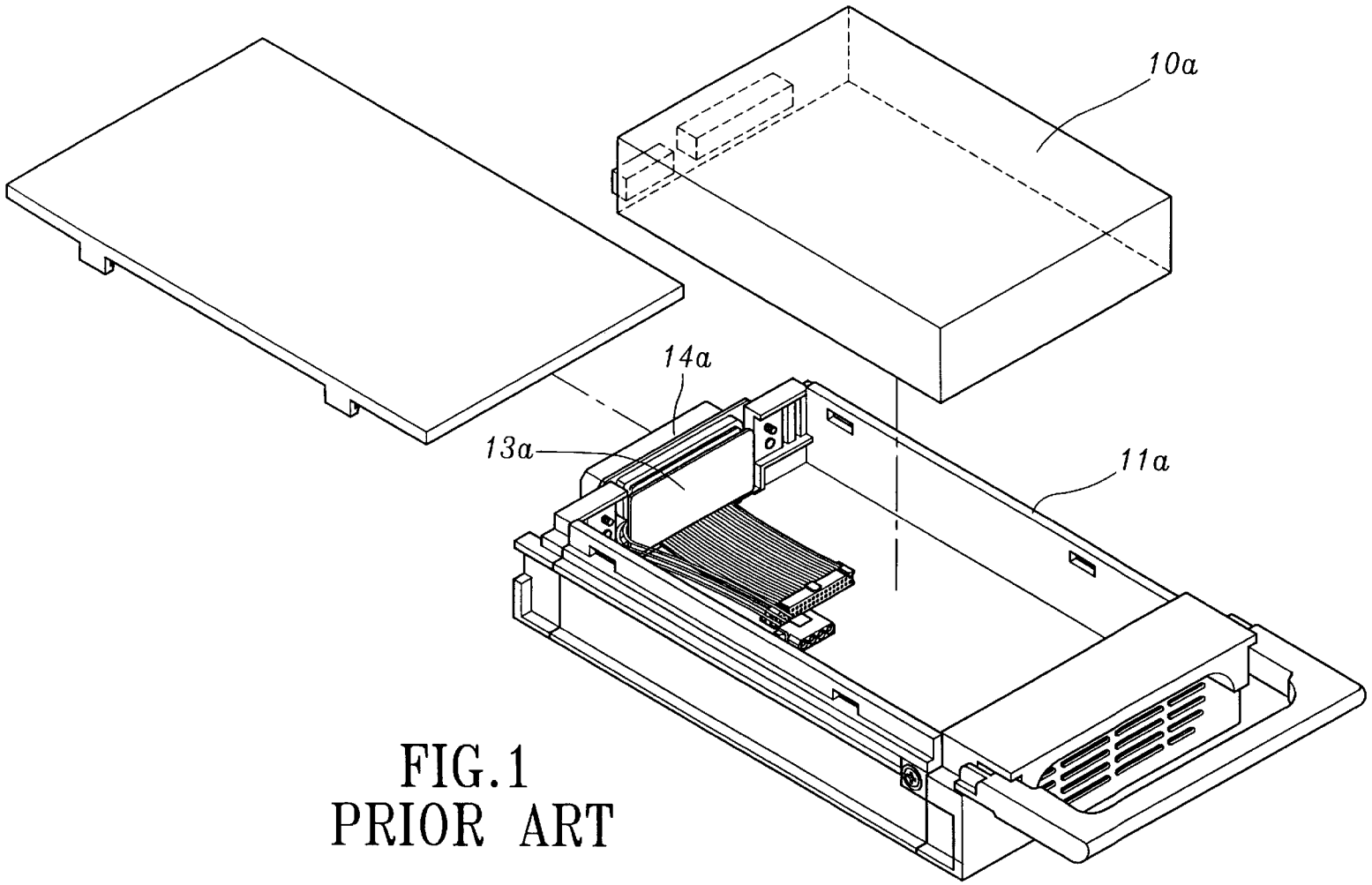
FIG. 1 PRIOR ART
FIG. 1 is a perspective view of the prior art removable hard disk driver and the mobile rack thereof.
Figure 2:
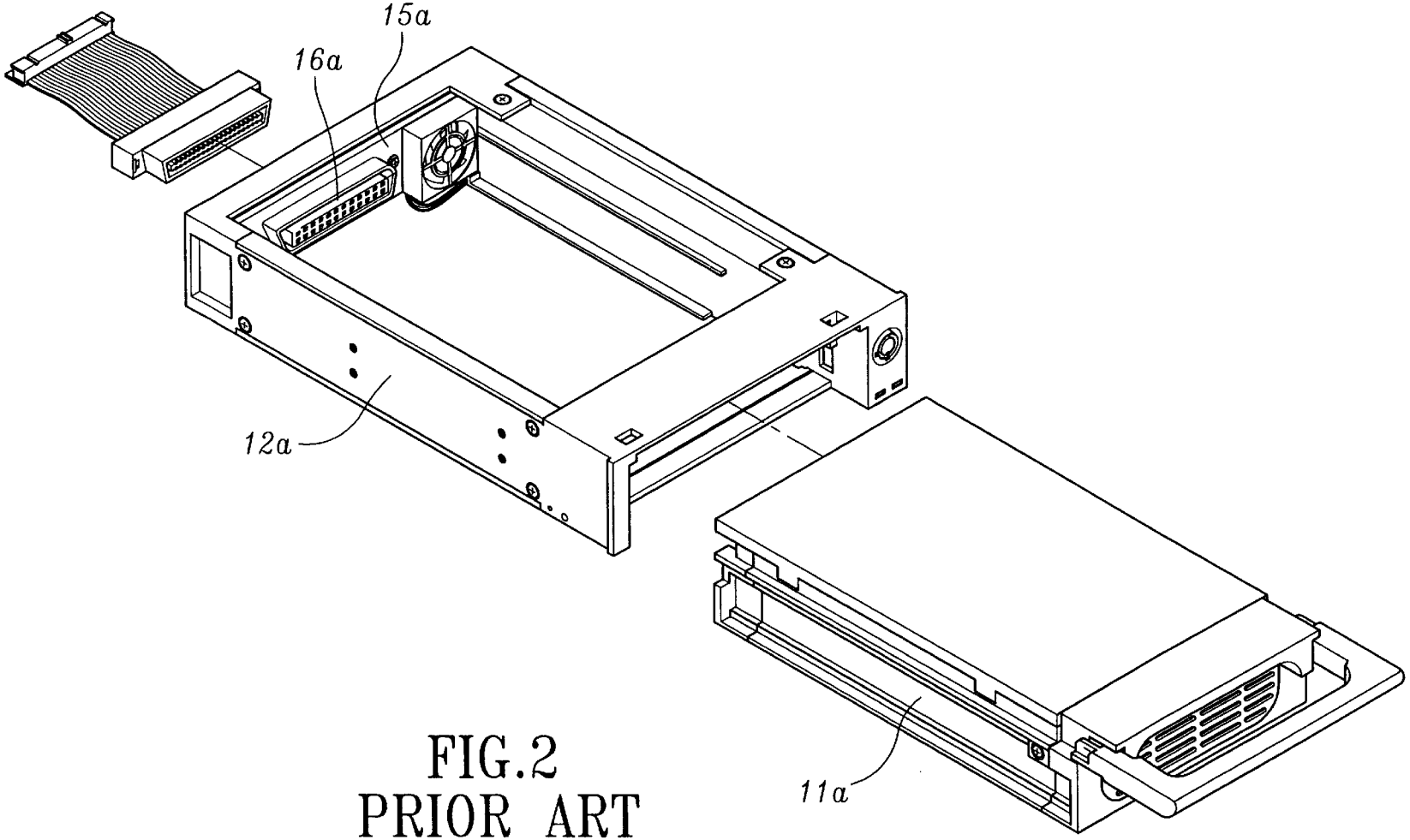
FIG.2 PRIOR ART
FIG. 2 is another perspective view of the prior art removable hard disk driver and the mobile rack thereof.
Figure 3:
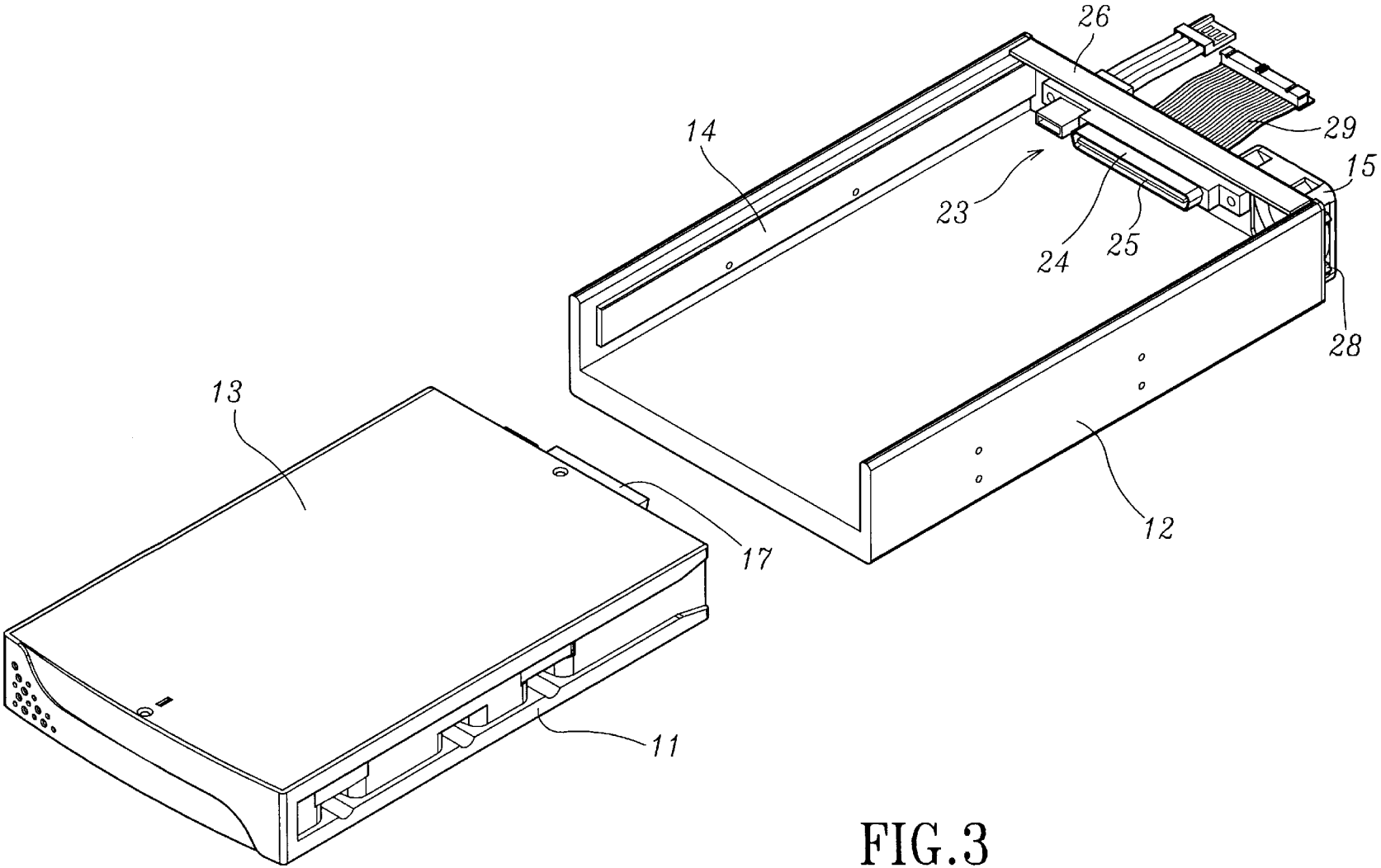
FIG. 3 is the perspective view of the present invention.
Figures 4, 4A:
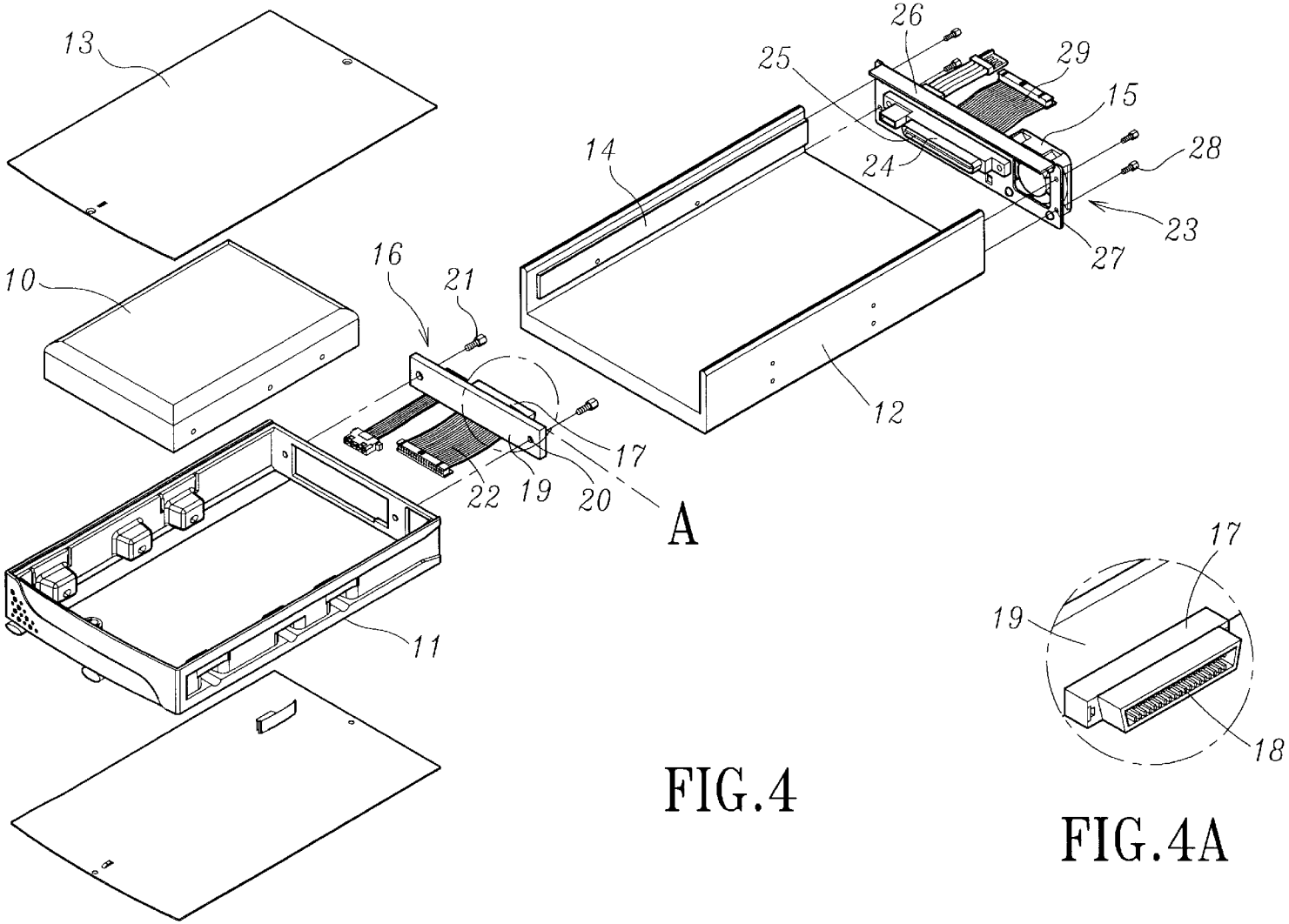
FIG. 4 is the exploded view of the present invention
FIG. 4A is an enlarged view of the first connector of the present invention.

FIG. 3 is the perspective view of the present invention; and FIG. 4 is the exploded view of the present invention. The preferred embodiment according to the present invention comprises a removable hard disk driver 10, an inner frame 11 and an outer frame 12 wherein the inner frame 1 1 is slidably fit within the outer frame 12. The inner frame 11 has a cover 13 on top and bottom sides thereof to seal the inner frame 11. The outer frame 12 has horizontal rails 14 on inner sides thereof for the sliding movement of the inner frame 11. The outer frame 12 has a fan 15 on rear side thereof for heat dissipation.

The inner frame 11 has at least one first connector 16 on rear side thereof and comprising an insulating case 17 and a plurality of conductive terminals 18 within the insulating case 17. The insulating case 17 has a larger-area panel-shaped first retainer 19 on the rear end thereof. The first retainer 19 has two retaining holes 20 on both sides thereof. The first connector 16 is locked on the rear end of the inner frame 11 by screwing two screws 21 into the two retaining holes 20. The conductive terminals 18 of the first connector 16 are electrically connected to one end of a first flat cable 22. The other end of the first flat cable 22 is electrically connected to the hard disk driver 10.

The outer frame 12 has at least one second connector 23 on rear side thereof and comprising an insulating case 24 and a plurality of conductive terminals 25 within the insulating case 24. The insulating case 24 has a larger-area panel-shaped second retainer 26 on the rear end thereof. The second retainer 26 has four retaining holes 27 on both sides thereof. The second connector 26 is locked on the rear end of the outer frame 12 by screwing four screws 28 into the two retaining holes 27. The conductive terminals 25 of the second connector 23 are electrically connected to one end of a second flat cable 29. The other end of the second flat cable 29 is electrically connected to the motherboard (not shown). The second connector 26 is electrically connected to the first connector 16 to transmit electrical signal for the hard disk driver 10.

As can be seen from above description, the circuit boards on the inner frame and outer frame are eliminated in the present invention. The production cost is reduced. Moreover, the first and second connector are connected to the hard disk driver and the motherboard through the first and second flat cable, the signal transmission speed is enhanced.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A mobile rack for a removable hard disk drive, comprising:

an inner frame having a first retainer secured to a rear side of said inner frame, said first retainer having at least one first connector mounted thereto and being devoid of a circuit board, said first connector including (a) a first insulating case, (b) a plurality of conductive terminals disposed within said first insulating case, and (c) a first flat cable extending into said inner frame and having a first end respectively electrically coupled to said plurality of conductive terminals;

a hard disk drive mounted in said inner frame, said hard disk drive being electrically connected to a second end of said first flat cable; and, an outer frame adapted for slidably receiving said inner frame therein through a front side of said outer frame, said outer frame having a second retainer secured to a rear side thereof and being devoid of a circuit board, said second retainer having at least one second connector mounted thereto for releasable electrical coupling with said first connector, said second connector including (a) a second insulating case, (b) a plurality of conductive terminals disposed within said second insulating case, and (c) a second flat cable extending from said rear side of said outer frame and having a first end respectively electrically coupled to said plurality of conductive terminals of said second connector, a second end of said second flat cable being adapted for electrical coupling to a computing device.

2. The mobile rack for a removable hard disk drive as recited in claim 1, wherein said inner frame has a pair of longitudinally extended grooves respectively formed in external surfaces of opposing sides thereof.

3. The mobile rack for a removable hard disk drive as recited in claim 2, wherein said outer frame has a pair of longitudinally extended rails respectively coupled to opposing internal sides thereof for respective slidable insert into said pair of longitudinally extended grooves of said inner frame when said inner frame is slidably received within outer frame.

* * * * *